United States Patent [19]

Key

[11] 4,068,107

[45] Jan. 10, 1978

[54] SWITCH HAVING ENERGY-EFFICIENT STRUCTURAL CONFIGURATION

[76] Inventor: Edward H. Key, 910 E. Illinois St., Wheaton, Ill. 60187

[21] Appl. No.: 658,616

[22] Filed: Feb. 17, 1976

[51] Int. Cl.[2] ..... H01H 13/28

[52] U.S. Cl. ..... 200/67 G; 200/68

[58] Field of Search ..... 200/67 G, 68

[56] References Cited

U.S. PATENT DOCUMENTS

| | | | |
|---|---|---|---|
| 2,987,592 | 6/1961 | Johnson | 200/68 |
| 3,329,784 | 7/1967 | Rogero | 200/67 G |

FOREIGN PATENT DOCUMENTS

| | | | |
|---|---|---|---|
| 719,935 | 11/1931 | France | 200/68 |

*Primary Examiner*—David Smith, Jr.
*Attorney, Agent, or Firm*—Philip D. Freedman

[57] ABSTRACT

An electrical switch comprises a support, a pair of fixed contacts thereon, a switch actuating rocker platen pivotally mounted on the support for alternate pivotal movement into and out of engagement with the contacts, actuator means for pivoting the platen into and out of engagement, the actuator means comprising a pivoted lever, a spring-biased plunger means on the lever and engaging the switch actuating rocker platen for movement thereon whereby the platen rocks around the axis of its pivotal mounting to alternately engage with one of each of the fixed contacts. The spring-biased plunger means comprises a roller, bearing on and adapted to ride over the platen and rotatably attached to the pivoted lever at the roller's center of rotation. An improvement to this switch is provided wherein the platen is pivotally mounted at a point above the surface on which the roller rides and further wherein the radius of the roller equals the vertical distance from the platen to the point of pivotal mounting so that the center of rotation of the roller passes through the axis of the pivot point of the platen. The switch actuating rocker platen may comprise two intersecting arc-shaped sections, the platen so constructed that each of the sections has the pivot point of the pivoted lever as its center of curvature when the spring-biased plunger means is engaged with the respective section.

2 Claims, 6 Drawing Figures

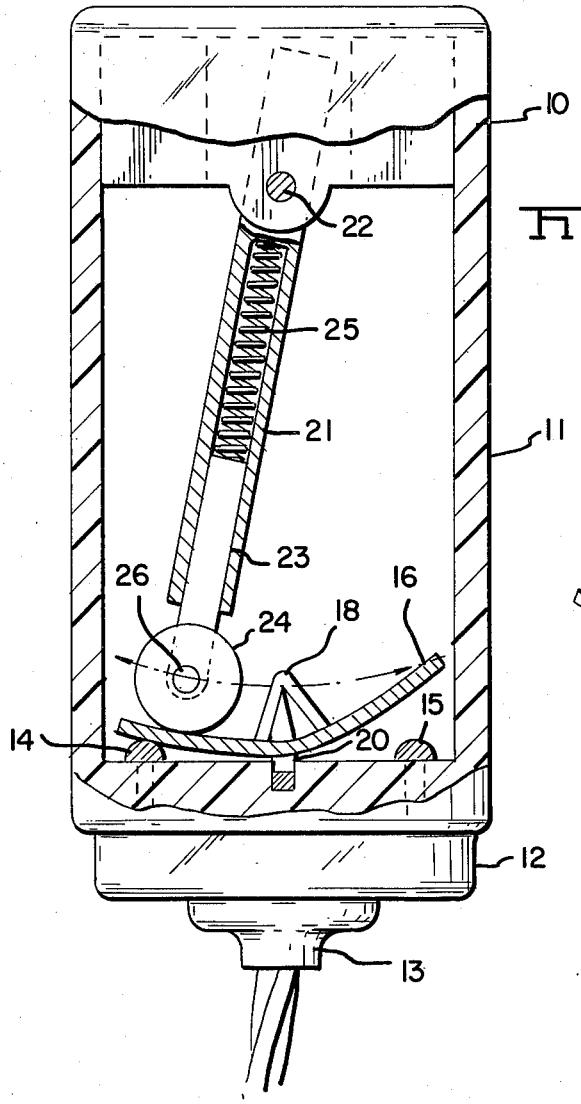
Fig. 1
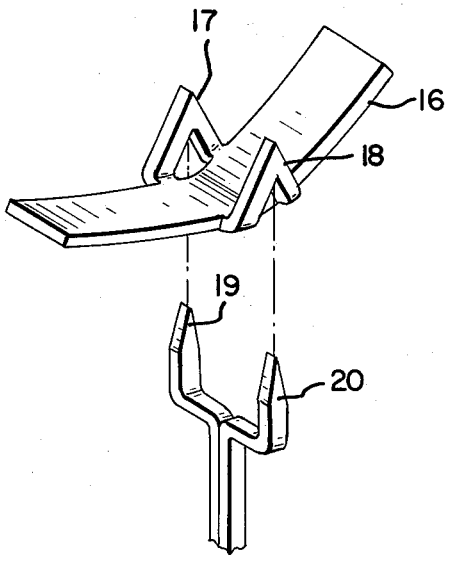
Fig. 2
Fig. 3
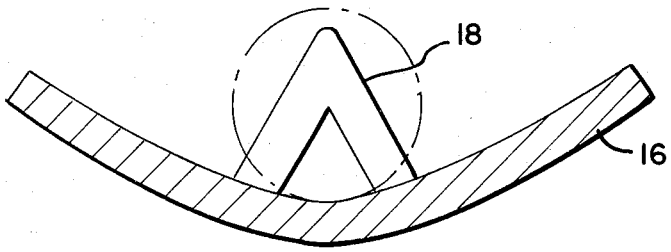

SWITCH HAVING ENERGY-EFFICIENT STRUCTURAL CONFIGURATION

This invention relates to electrical control devices and more particularly to improvements to switches comprising a pair of switch elements which are operated by a single operating lever.

Generally, such switches comprise a support, a pair of contacts thereon and a pivoted switch arm. The switch arm is adapted for alternate pivotal movement into and out of engagement with the fixed contact. Actuator means is provided for pivoting the switch arm. The actuator means comprises a pivoted lever and a spring-biased plunger means on the lever and a driver engaging the switch arm for movement thereon on each side of the pivot. The switch arm may take the form of a switch actuating rocker platen and the driver may be in the form of a roller, bearing on and adapted to ride over the platen as disclosed by Andrew, U.S. Pat. No. 2,832,852.

An object of the present invention is to provide an improved switch of this general type. It has been found that an improved switch is provided having structural features as will be described in detail below. By the present invention, a switch is provided comprising a support, a pair of fixed contacts thereon, a switch actuating rocker platen pivotally mounted on the support for alternate movement into and out of engagement with the fixed contacts, actuator means for pivoting the platen into and out of engagement, the actuator means comprising a pivoted lever, spring-biased means on the lever and engaging the switch actuating rocker platen for movement thereon, whereby the platen rocks around the axis of its pivotal mounting to alternately engage with one of each of the fixed contacts. This switch is improved in that the plunger means comprises a roller, bearing on and adapted to ride over the platen, and rotatably attached to the pivoted lever at the roller's center of rotation and having a radius such that and the pivoted mounting of said platen being located such that the center of rotation passes through the axis of pivot of the platen.

The switch actuating rocker may comprise two intersecting arc-shaped sections, the platen being so constructed that each of the sections has the pivot point of the pivoted lever as its center of curvature when the spring-biased plunger means is engaged with the respective section. It has been found that by these improvements, a switch is provided that operates with a maximum amount of contact force with a minimum amount of actuating energy.

The mechanism of this invention is particularly adaptable for use in combination with single pole double throw magnetic proximity switches. With such switches, the actuation energy is available in the form of a ferrous "target," passing through the lines of flux of a magnet. Since in such devices only a very small amount of actuation energy is available it is important that such switches be designed to most effectively utilize such available energy, a switch that will operate with a minimum of energy loss. It has been found with the present invention that large amounts of contact force may be imposed with only a minimum amount of actuation force.

Kreiger, U.S. Pat. No. 2,267,203 has a switch having means for affording only momentary positioning of a contactor in one or the other of each of its extreme positions or a two position switch wherein the contactor may be biased to one or the other of its extreme positions. Various other patents disclose switches of this general type. Goff, U.S. Pat. No. 2,369,964, teaches a snap action type switch mechanism including means for converting rotation of an engageable operating lever about one axis to rotation of a switch actuating member about a perpendicual axis while permitting overtravel of the operating lever in both directions with respect to the actuating member. Kohl, U.S. Pat. No. 2,469,337, shows a switch having a contact movable from engagement with a stationary contact when an actuator is moved in one direction and the actuator is released. The contact is again movable into engagement with the stationary contact when the actuator is again moved in the other direction. The actuator employs a roller means while the movable contact has a central apex from which oppositely inclined faces extend. Puccini, U.S. Pat. No. 3,322,914, relates to a similar type of electrical switch having three spaced terminal means and an electrically conductive U-shaped frame, the bight portion of which is mounted in electrically conductive relation on one of the terminal means; an elongated flexible electrically conductive contact arm having two opposite ends is provided along with two movable contacts, one mounted on each of the two opposite ends. A stiff actuator element having free end portions intermediate the U-shaped frame is positioned to underlay the opposite ends of the contact arm which contact arm is supported in electrically conductive relation on the distal portions of the U-shaped frame. The contact arm and actuator element is movable so that each movable contact mates with the respective one of the other two spaced terminal means. Actuator means is provided biasing the contact arm and actuator element against the U-shaped frame. The actuator element is movable from an at rest movable contact position where the extended line of biasing force passes through the distal portions of the U-shaped frame to an at-rest closed-contact position where the extended line of biasing forces passes without the distal positions of the U-shaped frame. Haderer, U.S. Pat. No. 3,399,285, shows a toggle type mechanism for actuating and de-actuating switches wherein movement of a pivoted toggle arm forces a roller over inclined surfaces pivotally mounted and underslung on the arm pivot, the roller shifting the positions of the surfaces for switch operation. The roller may be spring-biased to enable it to be retracted and extended as it moves over the surfaces. Braun, U.S. Pat. No. 3,439,138, discloses a switch wherein the actuator means returns to a center position while maintaining engagement of one pair of movable and fixed contacts for performing a memory function of indicating which set of contacts in a momentary switch was last actuated. Sanford, U.S. Pat. No. 3,482,067, relates to a three position toggle switch, which alternately closes one of three circuits between a common contact and respective additional contacts. The switch has a common contact in the form of a U-shaped bracket. This bracket has its central portion fixed to a base and has its ends upstanding from the base. Three additional contacts are spaced on the base and a contact arms means is rested across the upstanding ends of the U-shaped bracket to be rocked on the bracket into alternate engagement with the respective additional contacts. A toggle mounted on the base resiliently engages the central portion of the contact arm means between the upstanding ends of the U-shaped bracket to hold the contact arm means in engagement with the bracket contact and with one of the additional contacts for closing one circuit, the toggle being movable to either of two other alternate positions resiliently engaging respective end portions of the contact arm means for rocking the contact arm means on the bracket contact with snap action into alternate engagement with respective additional contacts for closing respective alternate circuits.

As shown in the following drawings, the invention has particular application as applied to a double throw limit switch of the snap action type having a switch actuating rocker platen alternatively latched in one of two pre-determined spaced circuit-completing positions and spring-biased plunger means for moving the switch actuating rocker platen and engaging and disengaging the contacts.

The invention may be best understood from the following detailed description. This description refers to a preferred embodiment and is presented in conjunction with the accompanying drawings.

FIG. 1 is a front elevation view of an exemplary switch of the present invention.

FIG. 2 is a perspective showing in detail the switch actuating rocker platen and pivot pins.

FIG. 3 is a front elevation detailed drawing of the switch actuating rocker platen and shows its novel configuration.

Corresponding reference characters indicate corresponding parts throughout the several views of the drawings.

Figure 6:
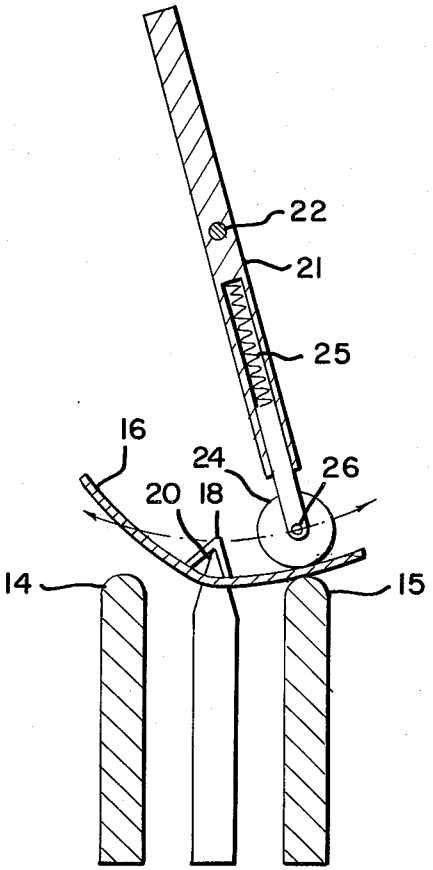
FIGS. 4, 5 and 6 are diagramatic representations illustrating the action of the spring-biased plunger means against the switch actuating rocker platen and the subsequent novel snap action provided thereby.

Referring now to the drawings, a switch assembly 10 comprises a hollow housing 11 having a switch base 12 and capped conduit connection 13 for the entrance of suitable electric conducting wires. Fixed contacts 14 and 15 are provided for alternate contact with switch actuating rocker platen 16. Platen 16 is pivotally mounted by means of two V-shaped rocker members 17 and 18 to respective pivot pins 19 and 20. Also shown is the pivoted lever 21 attached to the housing 11 at pivot point 22. The pivoted lever 21 comprises a spring-biased plunger means 23 and driver in the form of a roller 24 with said plunger means 23 and roller 24 biased to and against the track of the switch actuating rocker platen 16 by means of spring 25. The roller 24 is rotatably attached to the spring-biased plunger means 23 at point 26 which additionally is the center of rotation of said roller 24.

Figure 5:
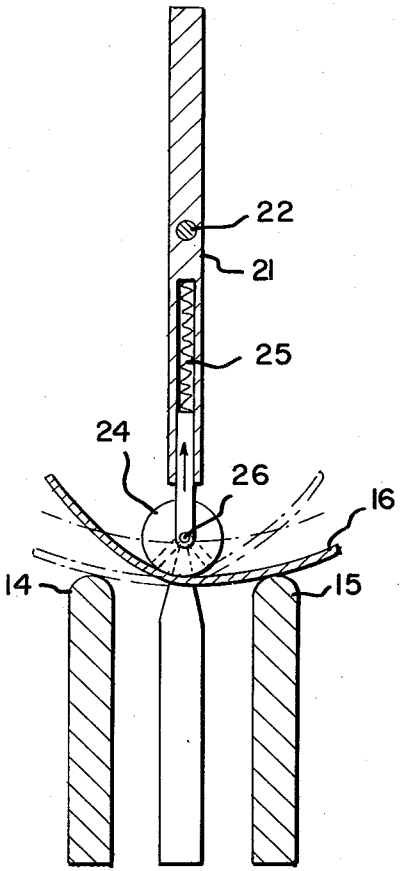
Figure 4:
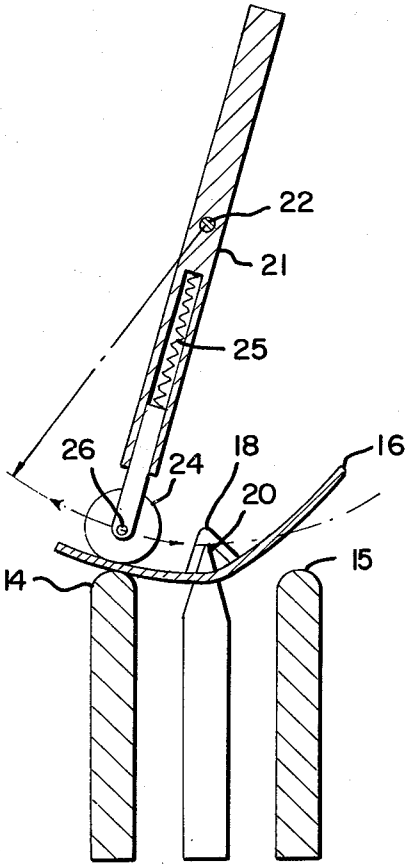

The drawings illustrate two of the novel features of the present invention. With particular reference to FIGS. 4, 5 and 6, the driver in the form of a roller 24 bears on and is adapted to ride over the switch actuator rocker platen 16. Platen 16 comprises a pair of arc-shaped sections joined at their ends to form a continuous track for roller 24. Roller 24 is resiliently urged into contact on the curved platen by the compression spring 25. The roller 24 may be caused to move from one end of the platen 16 to the other end thereof by pivotal movement of the pivoted lever 21 between the two positions of FIGS. 4 and 6 and through the transitional position of FIG. 5. So long as roller 24 bears on that half of platen 16 to the left as shown in FIG. 4, of a center plane extending through the pivot pins 19 and 20 and the pivot points of rocker members 17 and 18, spring 25 will act to maintain platen 16 in contact position with fixed contact 14. Simultaneously with the movement of roller 24 across and through said center plane by movement of the pivoted lever 21 from the position in FIG. 4 to that of FIG. 6, the switch actuating rocker platen will be snapped to its right hand contact position with fixed contact 15 as shown in FIG. 6.

One novel feature of the present invention is that the radius of roller 24 is such that its center of rotation 26 coincides with and passes through the axis of rotation of pivot of the rocker platen 16 as the roller 24 transfers from the left arc-shaped section to the right arc-shaped section of the platen 16 as illustrated in FIG. 5. In the embodiment shown in the drawings, the center of rotation 26 passes through a line (the axis of pivot) through the two points of contact between member 17 and pivot pin 19 and member 18 and pivot pin 20. It has been found that this particular configuration facilitates the snap action of the switch and moreover results in a minimum compression and/or extention of biasing spring 25.

Another feature of this invention is that the pivot point 22 of lever 21 is the center of curvature for the arc of the platen section on which the roller 24 is biased at any particular point of time. It has been found with this configuration that the roller 24 may move along the platen section without causing spring 25 to extend or compress. It has been found that by utilization of this feature and/or that described in the preceding paragraph, a device is provided that operates with a minimum amount of actuation force to provide a maximum of contact force. The present invention provides a device that is surprisingly energy efficient. Although the device of the present invention finds utility in any instance in which a toggle-type or the like switch may be employable, it is particularly useful as the operating mechanism of a proximity switch where it is advantageous to derive large contact forces from small amounts of available actuation energy.

The present invention may be described as an improvement to an electrical switch comprising a support, a pair of fixed contacts thereon, a switch actuating rocker platen pivotally mounted on said support for alternative pivotal movement into and out of engagement with said fixed contacts, actuator means for pivoting the platen into and out of engagement, said actuator means comprising a pivoted lever, spring-biased plunger means on said lever and engaging said switch actuating rocker platen for movement thereon, whereby said platen rocks around the axis of its pivotal mounting to alternately engage with one of each of said fixed contacts. The spring-biased plunger means comprises a roller, bearing on and adapted to ride over the platen, and rotatably attached to the pivoted lever at the roller's center of rotation.

In the description of the improvement, the platen is pivotally mounted at a point above the surface on which the roller rides and further the radius of the roller equals the vertical distance from the platen to the point of pivotal mounting so that the center of rotation of the roller passes through the axis of the pivot point of the platen. The switch actuating rocker platen may comprise two intersecting arc-shaped sections, said platen so constructed that each of said sections has the pivot point of said pivoted lever as its center of curvature when said spring-biased plunger means is engaged with the respective section. It has been found that switches utilizing one or both of these described improvements operate with a maximum amount of contact force with a minimum amount of actuating energy.

As noted above, the electrical switch of the present invention represents an energy-saving device as compared to conventional and similar switches of the prior art. Although it is preferred that the present invention incorporate both of the novel features described, a device with either of said features will show energy savings over prior art devices. With prior art devices, and in reference to FIG. 4, as a switch is activated, spring 25 will utilize a certain amount of energy in compressing as it moves toward the configuration shown in FIG. 5. However, it has been found, in accordance with the present invention, that the spring will not compress so long as the switch actuating rocker platen 16 is formed so that it comprises two intersecting arc-shaped sections, having the pivot point of the pivoted lever 21 as their respective centers of curvature.

Some compression will occur as the roller 24 passes from one section to another. However, this compression and subsequent loss of energy is eliminated by the second feature of the present invention, whereby the radius of roller 24 equals the vertical distance from the platen to its point of pivotal mounting 26 as shown in FIG. 5, so that the center rotation of said roller passes through the axis of the pivot point of the platen. In view of the above, it will be seen that the several objects of the invention are achieved, and other advantageous results obtained.

It should be understood that the invention is not limited to its application to the details of construction and arrangements of parts as illustrated in the accompanying drawings, (except insofar as the points of novelty are illustrated thereby), since the invention is capable of other embodiments and of being practiced or carried out in various ways. Also, it should be understood that the phraseology or terminology employed herein is for the purpose of description and not of limitation.

As numerous changes could be made in the described structures without departing from the scope of the invention, it is intended that all elements contained in the above descriptions or shown in the drawings shall be interpreted as illustrative and not in a limiting sense. And, it is also intended that the appended claims shall cover all such equivalent variations as come within the true spirit and scope of the invention.

What is claimed is:

1. An improvement to an electrical switch comprising a support, a pair of fixed contacts thereon, a switch actuating rocker platen pivotally mounted on said support for laternate pivotal movement into and out of engagement with said fixed contacts, actuator means for pivoting the platen into and out of engagement, said actuator means comprising a pivoted lever, spring-biased plunger means on said lever and engaging said switch actuating rocker platen for movement thereon, whereby said platen rocks around the axis of its pivotal mounting to alternately engage with one of each of said fixed contacts, wherein the spring-biased plunger means comprises a roller, bearing on and adapted to ride over said platen, and rotatably attached to said pivoted lever at the roller's center of rotation; the improvement wherein said platen is pivotally mounted at a point above the surface on which said roller rides and further wherein the radius of said roller equals the vertical distance from said platen to said point of pivitol mounting so that the center of rotation of said roller passes through the axis of the pivot point of said platen.

2. The electrical switch of claim 1 wherein the improvement comprises a switch actuating rocker platen comprising two intersecting arc-shaped sections, said platen constructed such that each of said sections has the pivot point of said pivoted lever as its center of curvature when said spring-biased plunger means is engaged with the respective section.

* * * * *